US006218063B1

(12) United States Patent
Tanaka et al.

(10) Patent No.: US 6,218,063 B1
(45) Date of Patent: Apr. 17, 2001

(54) ELECTROPHOTOGRAPHIC PHOTOSENSITIVE MEMBER, PROCESS CARTRIDGE, AND ELECTROPHOTOGRAPHIC APPARATUS

(75) Inventors: Masato Tanaka, Shizuoka-ken; Kouichi Nakata, Numazu; Kan Tanabe, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/379,732

(22) Filed: Aug. 24, 1999

(30) Foreign Application Priority Data

Aug. 26, 1998 (JP) ..... 10-254669
Aug. 26, 1998 (JP) ..... 10-254670

(51) Int. Cl.[7] ..... G03G 5/047

(52) U.S. Cl. ..... 430/59.4; 430/56; 399/111; 399/159

(58) Field of Search ..... 430/59.2, 59.4, 430/56; 399/111, 159

(56) References Cited

U.S. PATENT DOCUMENTS 5,595,845 * 1/1997 Maeda et al. ..... 430/59.2
5,725,985 * 3/1998 Nealey et al. ..... 430/59.4

FOREIGN PATENT DOCUMENTS 0 715217 6/1996 (EP) .
0 743561 11/1996 (EP) .
0 823668 2/1998 (EP) .
263007 10/1993 (JP) .
128888 5/1995 (JP) .
175241 7/1995 (JP) .

OTHER PUBLICATIONS

Chemical Abstracts 123:97891, 1995.*

* cited by examiner

*Primary Examiner*—Christopher Rodee
(74) *Attorney, Agent, or Firm*—Fitzpatrick, Cella, Harper & Scinto

(57) ABSTRACT

An electrophotographic photosensitive member comprising a support and a photosensitive layer provided on the support. The photosensitive layer contains a disazo pigment represented by the following Formula (1) or (2) and a hydroxygallium phthalocyanine;

(1)

wherein $A_1$ and $A_2$ may be the same or different and each represent a coupler residual group having a phenolic hydroxyl group;

(2)

wherein $A_3$ and $A_4$ may be the same or different and each represent a coupler residual group having a phenolic hydroxyl group.

11 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, and more particularly to an electrophotographic photosensitive member having a photosensitive layer containing a specific compound. This invention also relates to a process cartridge and an electrophotographic apparatus which have such an electrophotographic photosensitive member.

2. Related Background Art

Electrophotographic photosensitive members making use of organic photoconductive materials have greatly been improved in their sensitivity and durability (or running performance) as a result of the advancement of function-separated photosensitive members comprising a charge generation layer containing a charge-generating material and a charge transport layer containing a charge-transporting material which are superposed, and have been widely put into practical use.

Meanwhile, in recent years, photosensitive members having a broad spectral sensitivity ranging from visible to infrared wavelength regions are energetically developed so that copying machines can be made to have the function of writing by laser light. As a means for achieving such an object, it is known to use a charge generation layer formed of a charge-generating material having a sensitivity in the visible light region and a charge-generating material having a sensitivity in the infrared region which are mixed with each other or superposed in layers.

Printers to which electrophotography is applied are in wide use as terminal unit printers. These are chiefly laser beam printers having lasers as light sources. As the light sources, semiconductor lasers are used in view of the cost, the size of apparatus and so forth. Semiconductor lasers prevalingly used at present have an oscillation wavelength as long as 790 to 820 nm. Accordingly, electrophotographic photosensitive members having sufficient sensitivities in such a long-wavelength region are being developed, and, in order to improve sensitivity and running performance, it is known to use the charge transport layer formed of charge-generating materials which are mixed with each other or superposed in layers.

As a combination of an azo pigment with a phthalocyanine compound, Japanese Patent Application Laid-open No. 7-175241 disclose a photosensitive member making use of a specific azo pigment and an oxytitanium phthalocyanine; and Japanese Patent Application Laid-open No. 7-128888, a photosensitive member making use of a specific azo pigment and a gallium phthalocyanine.

These photosensitive members, however, are disadvantageous in that the properties of the respective charge-generating materials can not well be exhibited and, especially when used in a mixture, their potential variations become great during running as memory characteristics become poor. Use of the gallium phthalocyanine may result in a poor chargeability to cause image deterioration due to dots or fog. Also, it can not be said that the sensitivity itself in the visible and infrared regions are satisfactory.

SUMMARY OF THE INVENTION

An object of the present invention is to eliminate the disadvantages the prior art has and to provide an electrophotographic photosensitive member having a high sensitivity, promising a high image quality and undergoing less potential variations.

Another object of the present invention is to provide a process cartridge and an electrophotographic apparatus which employ such an electrophotographic photosensitive member.

The present invention provides an electrophotographic photosensitive member comprising a support and a photosensitive layer provided on the support;

the photosensitive layer containing a disazo pigment represented by the following Formula (1) or (2) and a hydroxygallium phthalocyanine.

(1)

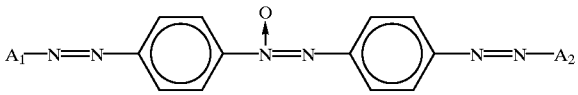

wherein $A_1$ and $A_2$ may be the same or different and each represent a coupler residual group having a phenolic hydroxyl group.

(2)

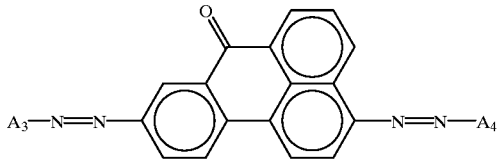

wherein $A_3$ and $A_4$ may be the same or different and each represent a coupler residual group having a phenolic hydroxyl group.

The present invention also provides a process cartridge comprising the electrophotographic photosensitive member described above and at least one means selected from the group consisting of a charging means, a developing means and a cleaning means, which are supported as one unit and being detachably mountable to the main body of an electrophotographic apparatus.

The present invention still also provides an electrophotographic apparatus comprising the electrophotographic photosensitive member described above, a charging means, an exposure means, a developing means and a transfer means.

DESCRIPTION OF THE PREFERRED EMBODIMENTS

Figure 1:
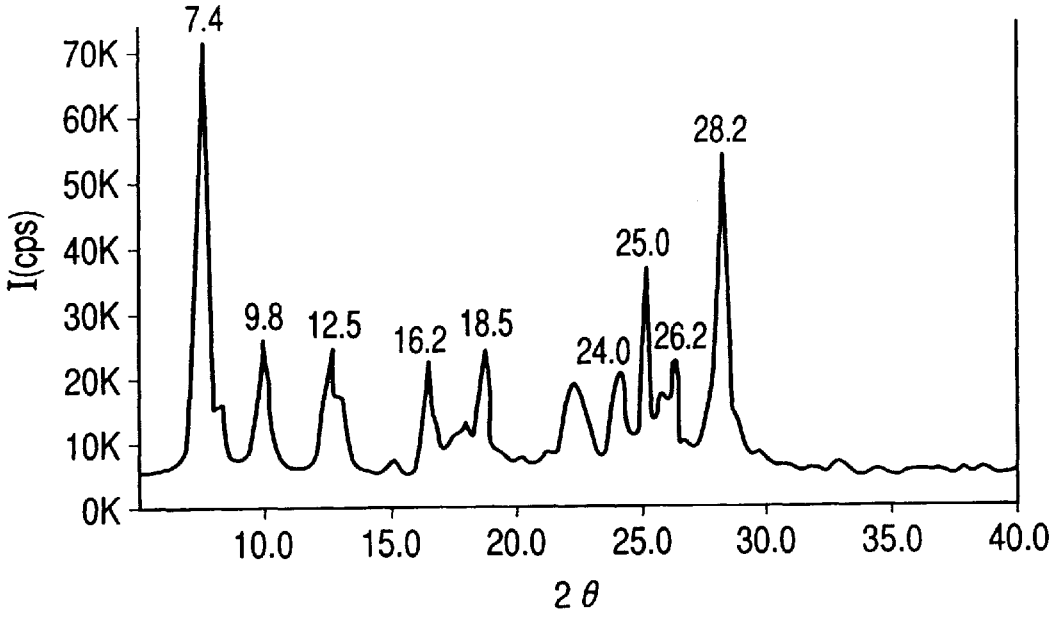
FIG. 1 shows an X-ray diffraction pattern of CuKα characteristics of hydroxygallium phthalocyanine synthesized in Production Example 2.

The electrophotographic photosensitive member of the present invention has a photosensitive layer on a support, and the photosensitive layer contains a disazo pigment represented by the following Formula (1) or (2) and a hydroxygallium phthalocyanine.

(1)

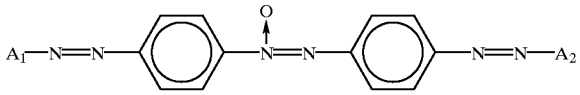

wherein $A_1$ and $A_2$ may be the same or different and each represent a coupler residual group having a phenolic hydroxyl group.

(2)

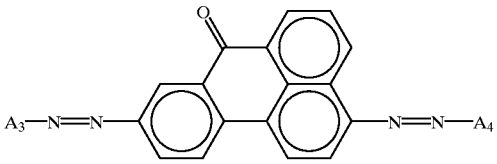

wherein $A_3$ and $A_4$ may be the same or different and each represent a coupler residual group having a phenolic hydroxyl group.

In the Formulas (1) and (2), $A_1$ to $A_4$ each represent a coupler residual group having a phenolic hydroxyl group. In particular, they each may preferably represent any one of groups represented by the following Formulas (3) to (6).

Formula(3)

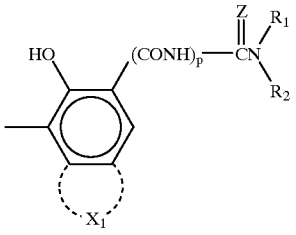

Formula(4)

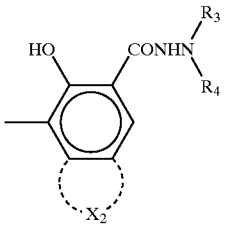

-continued

Formula(5)

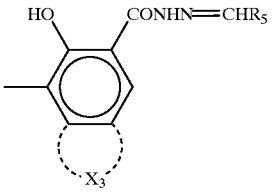

Formula (6)

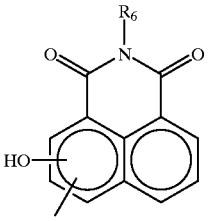

In Formulas (3), (4) and (5), $X_1$ to $X_3$ each represent a residual group necessary for combining with the benzene ring in the formula to form an aromatic hydrocarbon ring or heterocyclic ring such as a naphthalene ring, anthracene ring, carbazole ring, benzocarbazole ring or dibenzofuran ring which may be substituted.

In Formulas (3) and (4), $R_1$ to $R_4$ each represent a hydrogen atom, an alkyl group which may be substituted, an aryl group which may be substituted, an aralkyl group which may be substituted or a heterocyclic ring which may be substituted, and $R_1$ and $R_2$, and $R_3$ and $R_4$, may each combine to form a cyclic amino group together with the nitrogen atom in the formula.

In Formula (5), $R_5$ represents a hydrogen atom, an alkyl group which may be substituted, an aryl group which may be substituted, an aralkyl group which may be substituted or a heterocyclic ring which may be substituted.

In Formula (6), $R_6$ represents an alkyl group which may be substituted, an aryl group which may be substituted, an aralkyl group which may be substituted or a heterocyclic ring which may be substituted.

The above alkyl group may include groups such as methyl, ethyl and propyl; the aryl group, groups such as phenyl, naphthyl and anthryl; the aralkyl group, groups such as benzyl and phenethyl; the heterocyclic group, groups such as pyridyl, thienyl, thiazolyl, carbazolyl, benzimidazolyl and benzothiazolyl; and the cyclic amino group, groups such as pyrrole, pyrroline, pyrrolidine, pyrrolidone, indole, indoline, carbazole, imidazole, pyrazole, pyrazoline, oxazine and phenoxazine.

The substituents these groups may have may include alkyl groups such as methyl, ethyl and propyl; alkoxyl groups such as methoxy, ethoxy and propoxy; halogen atoms such as a fluorine atom, a chlorine and a bromine atom; dialkylamino groups such as dimethylamino and diethylamino; a phenylcarbamoyl group; a nitro group; a cyano group; and halomethyl groups such as trifluoromethyl.

In Formula (3), Z represents an oxygen atom or a sulfur atom, and p represents 0 or 1.

Of the above coupler residual groups, the group represented by Formula (3) is particularly preferred in view of sensitivity.

Preferable examples of the disazo pigments represented by Formulas (1) and (2) are shown below. The present invention is by no means limited thereto.

Basic formula of the disazo pigment represented by Formula (1):
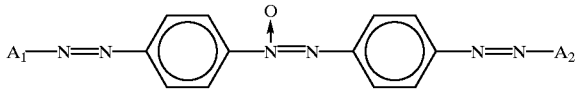
Exemplary Pigment (1)-1
$A_1$, $A_2$:
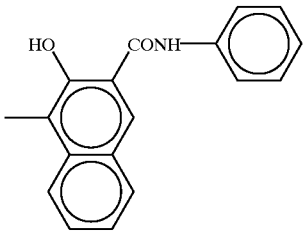
Exemplary Pigment (1)-2
$A_1$, $A_2$:
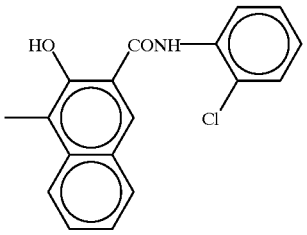
Exemplary Pigment (1)-3
$A_1$, $A_2$:
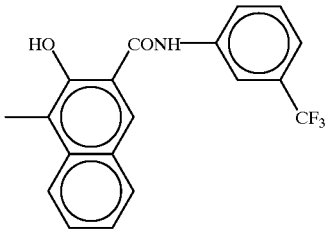
Exemplary Pigment (1)-4
$A_1$, $A_2$:
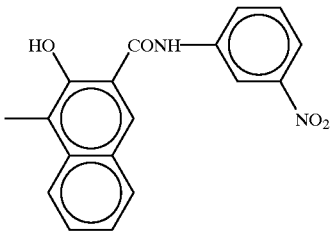
Exemplary Pigment (1)-5
$A_1$, $A_2$:
-continued
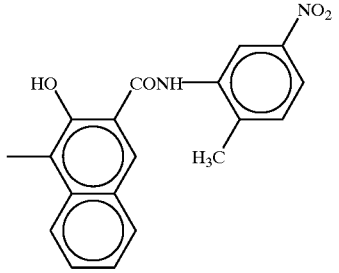
Exemplary Pigment (1)-6
$A_1$, $A_2$:
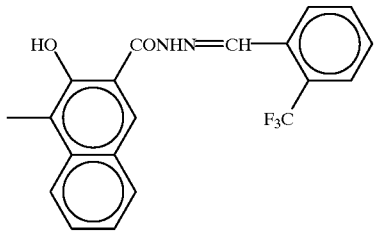
Exemplary Pigment (1)-7
$A_1$, $A_2$:
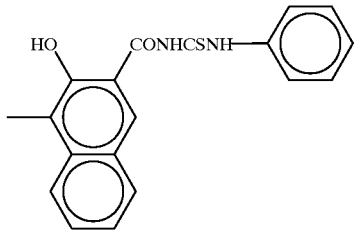
Exemplary Pigment (1)-8
$A_1$, $A_2$:
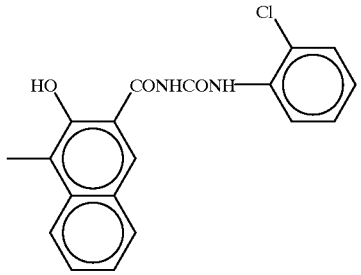
Exemplary Pigment (1)-9
$A_1$, $A_2$:
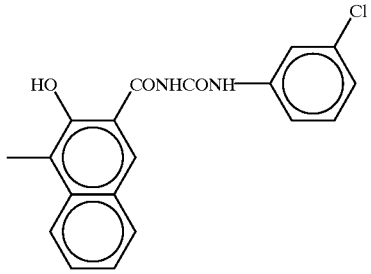
Exemplary Pigment (1)-10
$A_1$, $A_2$:

-continued
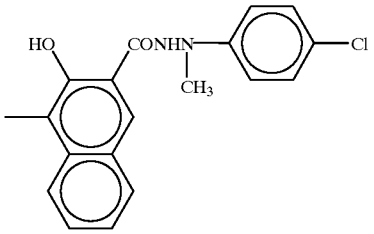
Exemplary Pigment (1)-11
$A_1$, $A_2$:
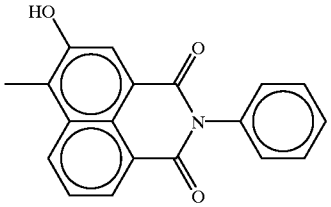
Exemplary Pigment (1)-12
$A_1$, $A_2$:
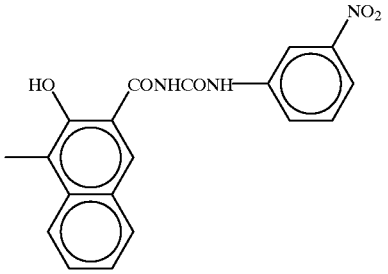
Exemplary Pigment (1)-13
$A_1$, $A_2$:
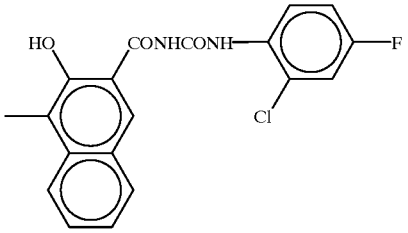
Exemplary Pigment (1)-14
$A_1$, $A_2$:
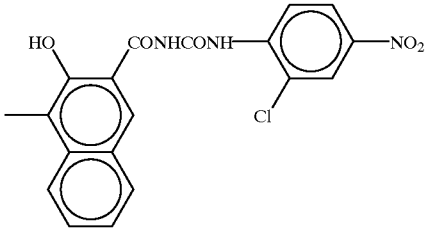
Exemplary Pigment (1)-15
$A_1$, $A_2$:
-continued
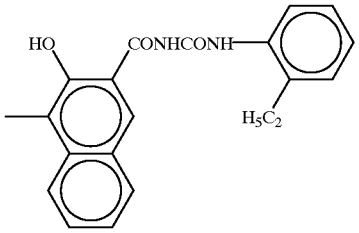
Exemplary Pigment (1)-16
$A_1$, $A_2$:
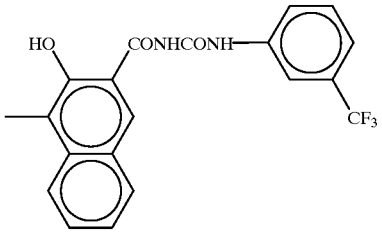
Exemplary Pigment (1)-17
$A_1$, $A_2$:
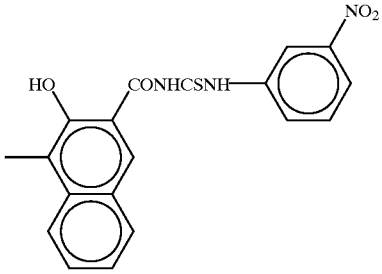
Exemplary Pigment (1)-18
$A_1$, $A_2$:
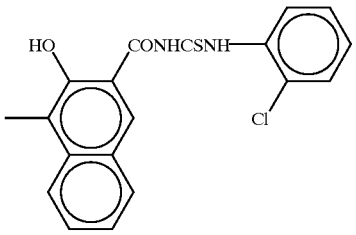
Exemplary Pigment (1)-19
$A_1$, $A_2$:
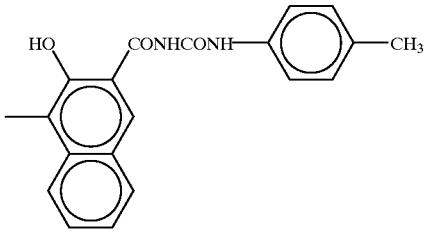
Exemplary Pigment (1)-20
$A_1$, $A_2$:

-continued
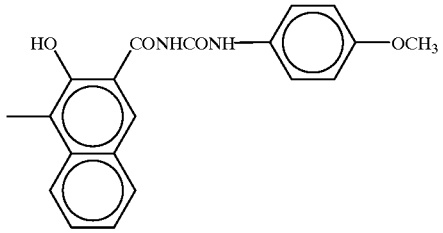
Exemplary Pigment (1)-21
$A_1$, $A_2$:
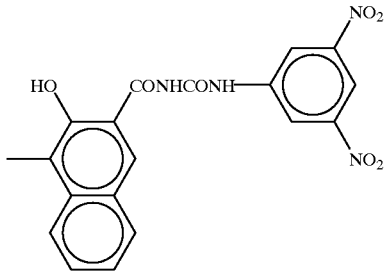
Exemplary Pigment (1)-22
$A_1$:
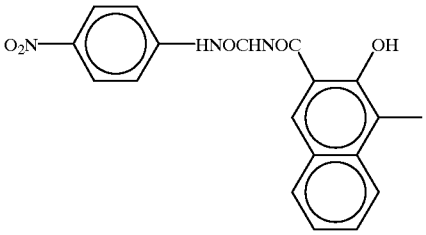
$A_2$:
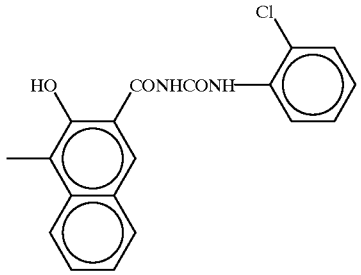
Exemplary Pigment (1)-23
$A_1$:
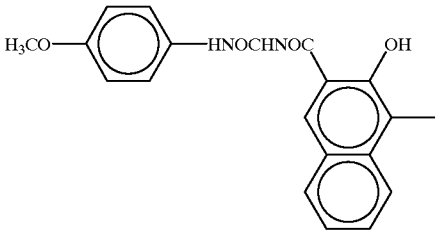
$A_2$:
-continued
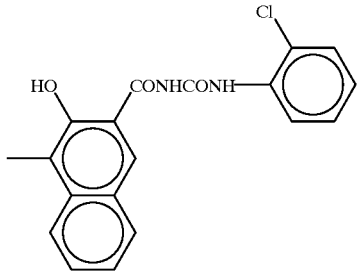
Exemplary Pigment (1)-24
$A_1$:
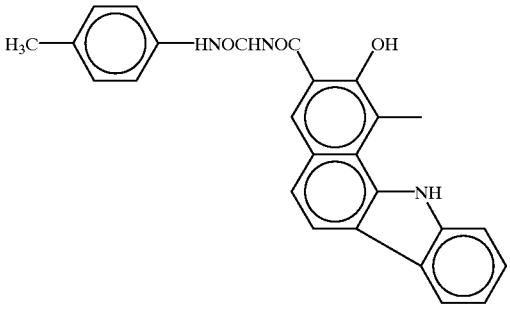
$A_2$:
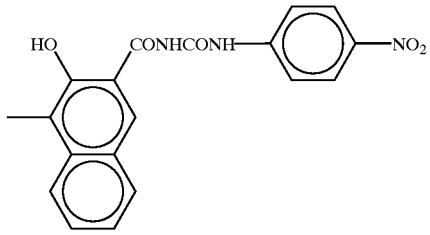
Exemplary Pigment (1)-25
$A_1$:
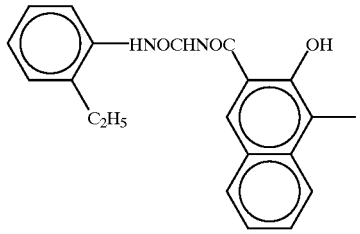
$A_2$:
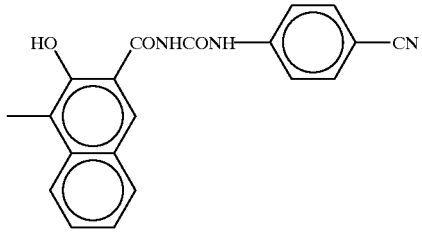
Exemplary Pigment (1)-26
$A_1$:

-continued
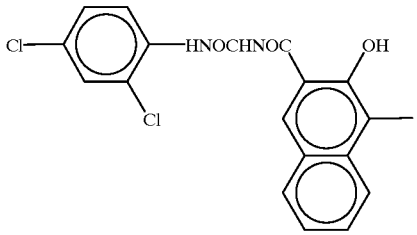
$A_2$:
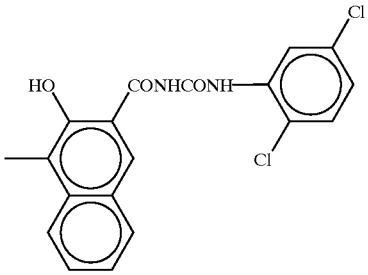
Exemplary Pigment (1)-27
$A_1$:
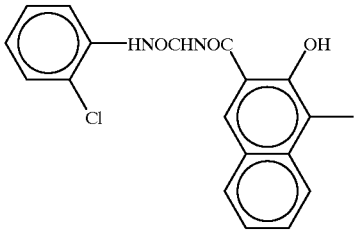
$A_2$:
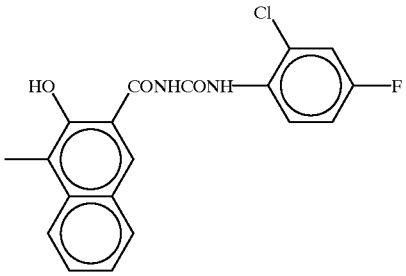
Exemplary Pigment (1)-28
$A_1$:
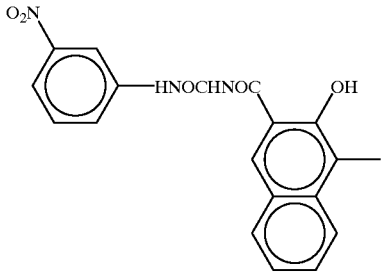
$A_2$:
-continued
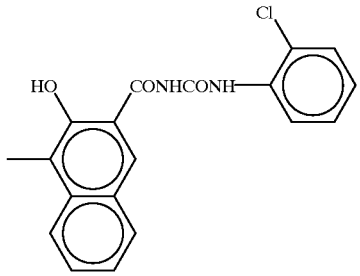
Exemplary Pigment (1)-29
$A_1$, $A_2$:
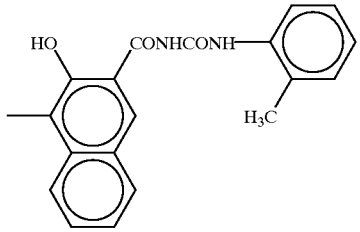
Basic formula of the disazo pigment represented by Formula (2):
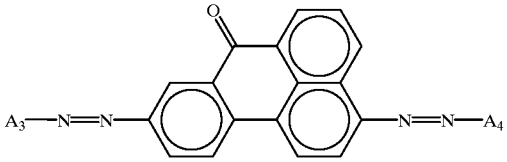
Exemplary Pigment (2)-1
$A_3$, $A_4$:
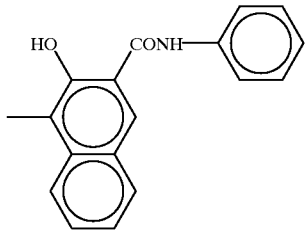
Exemplary Pigment (2)-2
$A_3$, $A_4$:
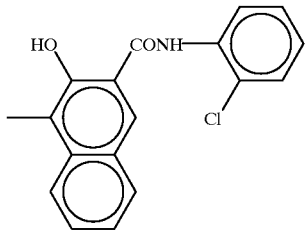
Exemplary Pigment (2)-3
$A_3$, $A_4$:

-continued
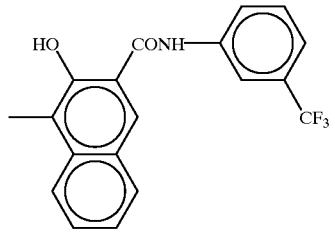
Exemplary Pigment (2)-4
$A_3$, $A_4$:
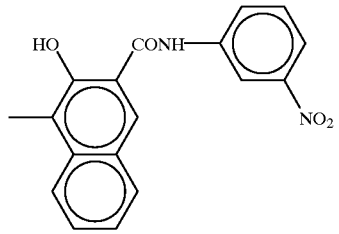
Exemplary Pigment (2)-5
$A_3$, $A_4$:
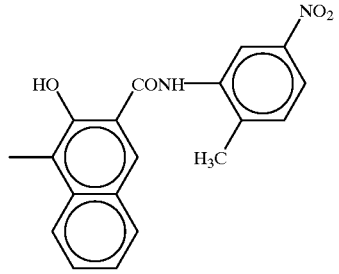
Exemplary Pigment (2)-6
$A_3$, $A_4$:
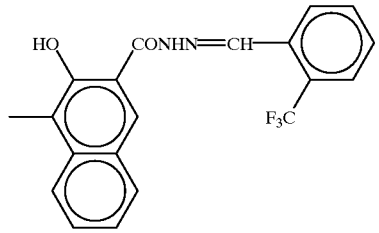
Exemplary Pigment (2)-7
$A_3$, $A_4$:
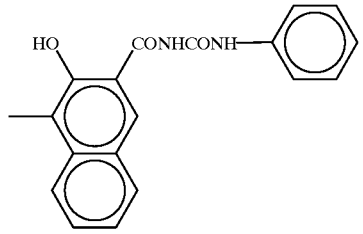
Exemplary Pigment (2)-8
$A_3$, $A_4$:
-continued
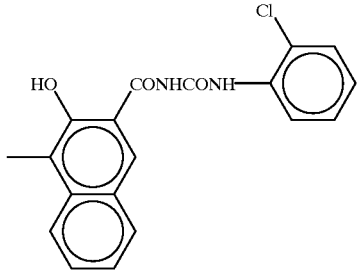
Exemplary Pigment (2)-9
$A_3$, $A_4$:
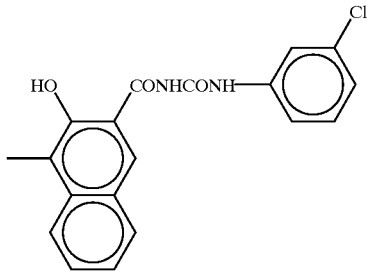
Exemplary Pigment (2)-10
$A_3$, $A_4$:
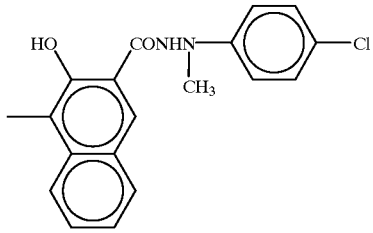
Exemplary Pigment (2)-11
$A_3$, $A_4$:
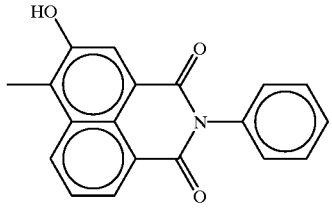
Exemplary Pigment (2)-12
$A_3$, $A_4$:
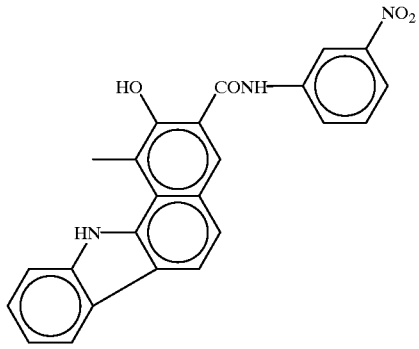

-continued
Exemplary Pigment (2)-13
$A_3$, $A_4$:
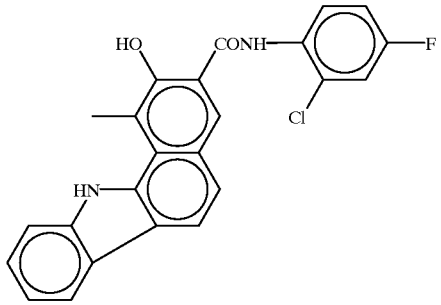
Exemplary Pigment (2)-14
$A_3$, $A_4$:
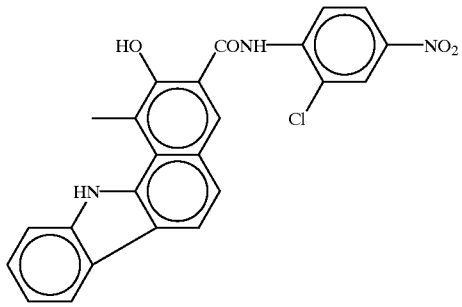
Exemplary Pigment (2)-15
$A_3$, $A_4$:
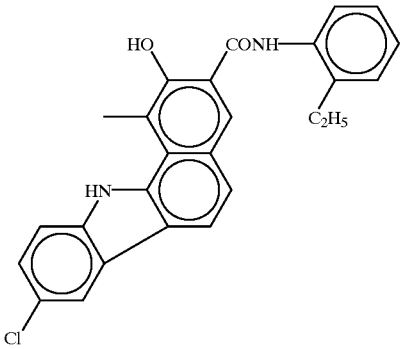
Exemplary Pigment (2)-16
$A_3$, $A_4$:
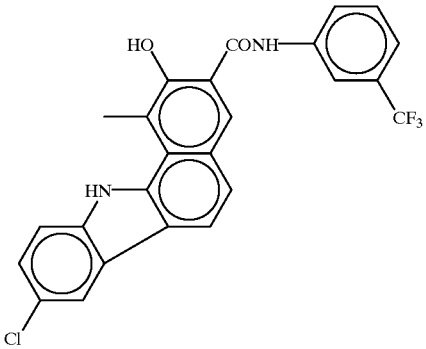
Exemplary Pigment (2)-17
$A_3$, $A_4$:
-continued
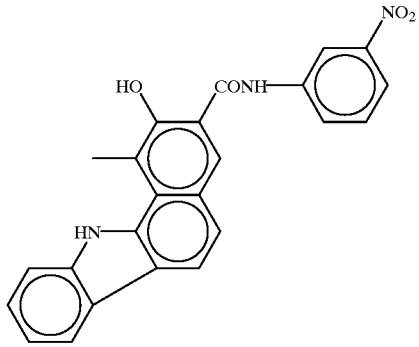
Exemplary Pigment (2)-18
$A_3$, $A_4$:
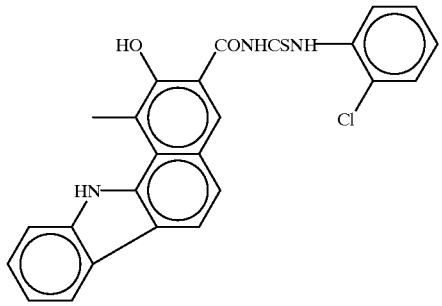
Exemplary Pigment (2)-19
$A_3$, $A_4$:
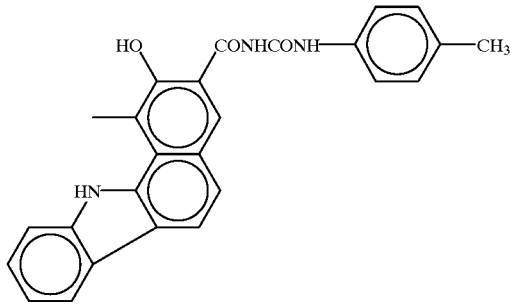
Exemplary Pigment (2)-20
$A_3$, $A_4$:
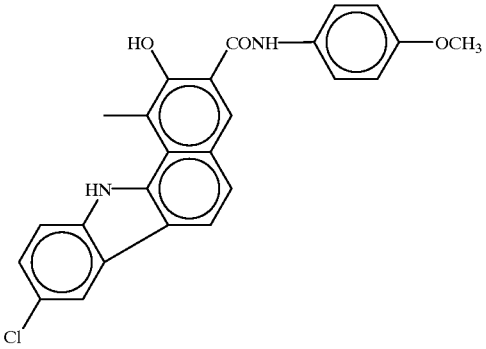
Exemplary Pigment (2)-21
$A_3$, $A_4$:

-continued
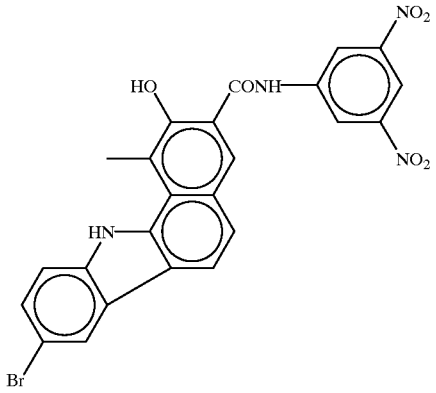
Exemplary Pigment (2)-22
$A_3$:
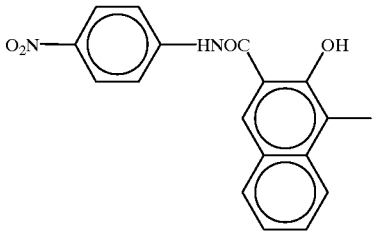
$A_4$:
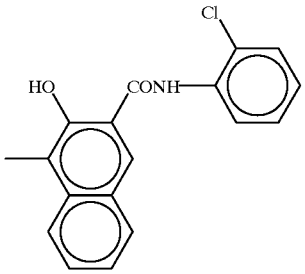
Exemplary Pigment (2)-23
$A_3$:
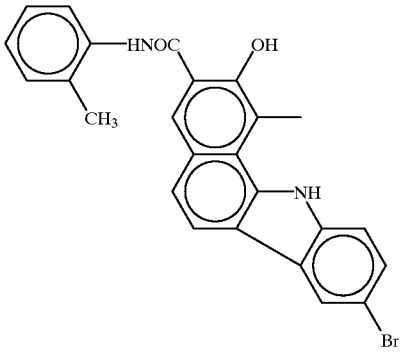
$A_4$:
-continued
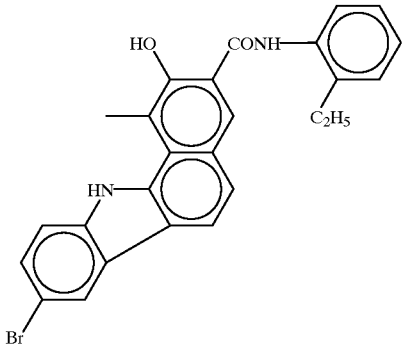
Exemplary Pigment (2)-24
$A_3$:
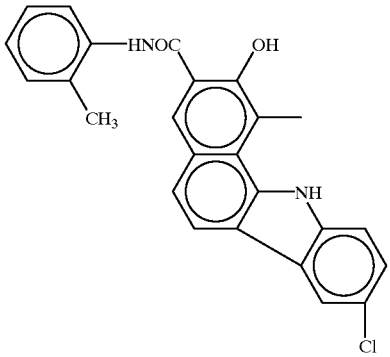
$A_4$:
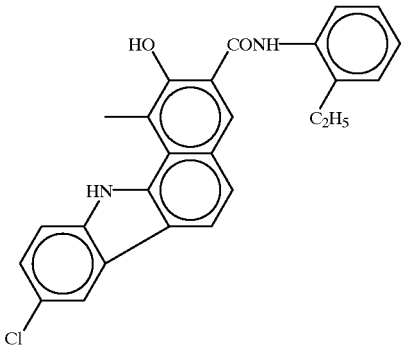
Exemplary Pigment (2)-25
$A_3$:
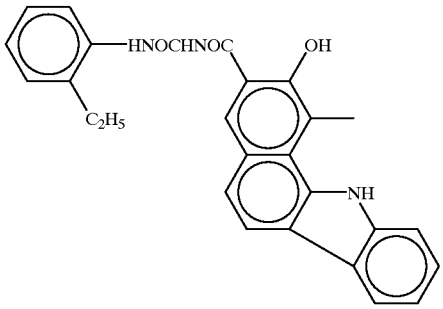
$A_4$:

-continued

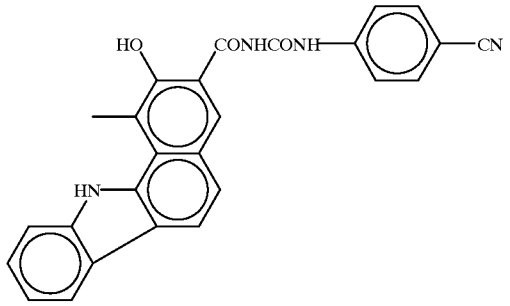

Exemplary Pigment (2)-26

$A_3$:

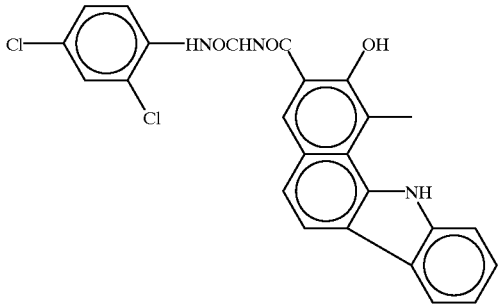

$A_4$:

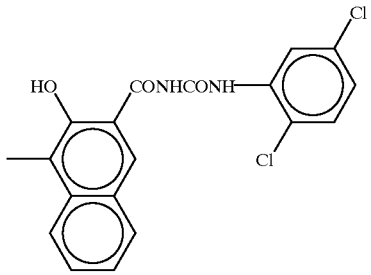

Exemplary Pigment (2)-27

$A_3$:

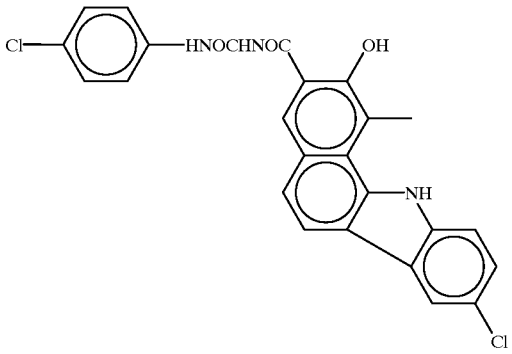

$A_4$:

-continued

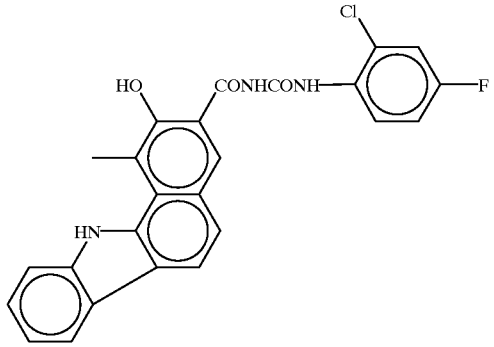

Exemplary Pigment (2)-28

$A_3$:

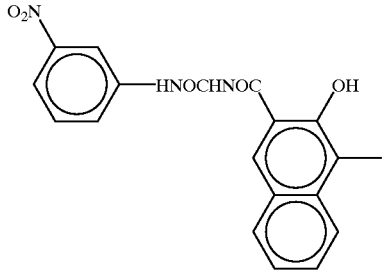

$A_4$:

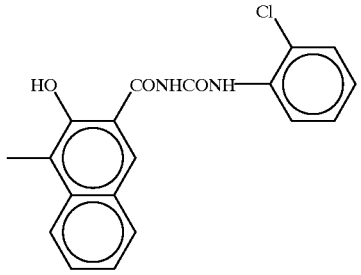

Exemplary Pigment (2)-29

$A_3$, $A_4$:

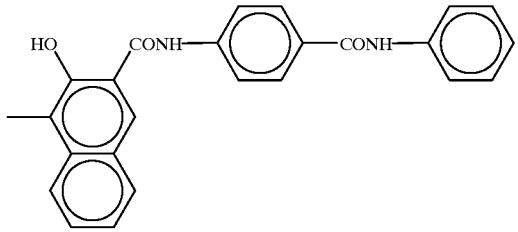

Of these examples, the disazo pigments of Exemplary Pigments (1)-8 and (2)-15 are particularly preferred.

The disazo pigments represented by Formulas (1) and (2) can readily be synthesized by;

tetrazotizing the corresponding diamine by a conventional process, followed by coupling with the coupler in the presence of an alkali in an aqueous system; or isolating a tetrazonium salt of the diamine in the form of a borofluoride or a zinc chloride complex salt, followed by coupling with the coupler in the presence of a base such as sodium acetate, triethylamine or N-methylmorpholine in a solvent such as N,N-dimethylformamide or dimethylsulfoxide.

The hydroxygallium phthalocyanine (hereinafter referred to as "HOGaPC") used in the present invention is represented by the following formula.

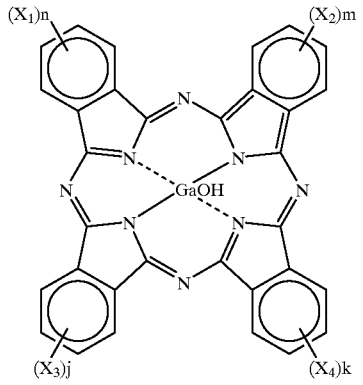

wherein $X_1$, $X_2$, $X_3$ and $X_4$ each represent Cl or Br; and n, m, k and j each represent an integer of 0 to 4.

The HOGaPC includes those having various crystal forms. In the present invention, HOGaPC having any crystal forms may be used. In particular, an HOGaPC having strong peaks at 7.4°±0.2° and 28.2°±0.2° of the Bragg's angle (2θ) in CuKα characteristic X-ray diffraction (FIG. 1, as disclosed in, e.g., Japanese Patent Application Laid-open No. 5-263007) is preferred because it has a high sensitivity and the present invention can effectively operate.

In the present invention, the HOGaPC and the specific disazo pigment may preferably be contained in a ratio (weight ratio) of from 20/1 to 1/20, and particularly preferably from 10/1 to 1/5, as HOGaPC/disazo pigment.

In the electrophotographic photosensitive member of the present invention, the photosensitive layer may be of any configuration, including a multi-layer type having a charge generation layer containing a charge-generating material and a charge transport layer containing a charge-transporting material, and a single-layer type containing both the charge-generating material and the charge-transporting material in the same layer. In the case of the multi-layer type, there are two ways of superposing the layers. In particular, a configuration wherein the charge generation layer and the charge transport layer are superposed in this order from the support side is preferred in view of electrophotographic performance.

The charge generation layer contains the HOGaPC and the disazo pigments represented by formula (1) or (2), as charge-generating materials, and a binder resin. When the charge-generating materials are mixed, the materials may be dispersed in a ratio within the above range in suitable binder resin and solvent, or their dispersions individually prepared may be mixed with each other in a prescribed ratio or superposed in layers. When dispersions are individually prepared, binder resins and solvents may respectively differ from each other. When superposed in layers, the dispersions individually prepared may be applied in such a way that A the materials contained are in a prescribed weight ratio.

The binder resin used may include polyesters, acrylic resins, polyvinyl carbazole, phenoxy resins, polycarbonate, polyvinyl butyral, polyvinyl benzal, polystyrene, polyvinyl acetate, polysulfone, polyarylates, and vinylidene chloride-acrylonitrile copolymer.

The charge transport layer is formed by applying a coating solution prepared by chiefly dissolving a charge-transporting material and a binder resin in a solvent, followed by drying. The charge-transporting material used may include various types of triarylamine compounds, hydrazone compounds, stilbene compounds, pyrazoline compounds, oxazole compounds, thiazole compounds and triallylmethane compounds. As the binder resin, the same resins as those for the charge generation layer may be used.

In the case of the photosensitive layer of a single-layer type, it can be formed by applying a coating fluid containing the charge-generating material, the charge-transporting material and the binder resin, followed by drying.

The support may be any of those having a conductivity and may include metals such as aluminum and stainless steel, and metals, plastics or papers provided with conductive layers. The support may be in the form of a cylinder or a film.

A subbing layer having a barrier function and an adhesion function may be provided between the support and the photosensitive layer. Materials for the subbing layer may include polyvinyl alcohol, polyethylene oxide, ethyl cellulose, methyl cellulose, casein, polyamide, glue and gelatin. These are each dissolved in a suitable solvent, and applied onto the support.

Between the support and the subbing layer, a conductive layer may also be provided so that any unevenness or defects on the support can be covered and interference fringes due to light scattering can be prevented when images are inputted using laser light. This layer may be formed by dispersing a conductive powder such as carbon black, metal particles or metal oxide in the binder resin. The conductive layer may preferably have a layer thickness of from 5 to 40 μm, and particularly preferably from 10 to 30 μm.

These layers may be coated by a method including dip coating, spray coating, spin coating, bead coating, blade coating and beam coating.

The electrophotographic photosensitive member of the present invention can be not only utilized in electrophotographic copying machines, but also widely used in the field in which the electrophotography is applied as exemplified by laser beam printers, CRT printers, LED printers, liquid-crystal printers and laser beam engravers.

The process cartridge and electrophotographic apparatus of the present invention are described below.

Figure 5:
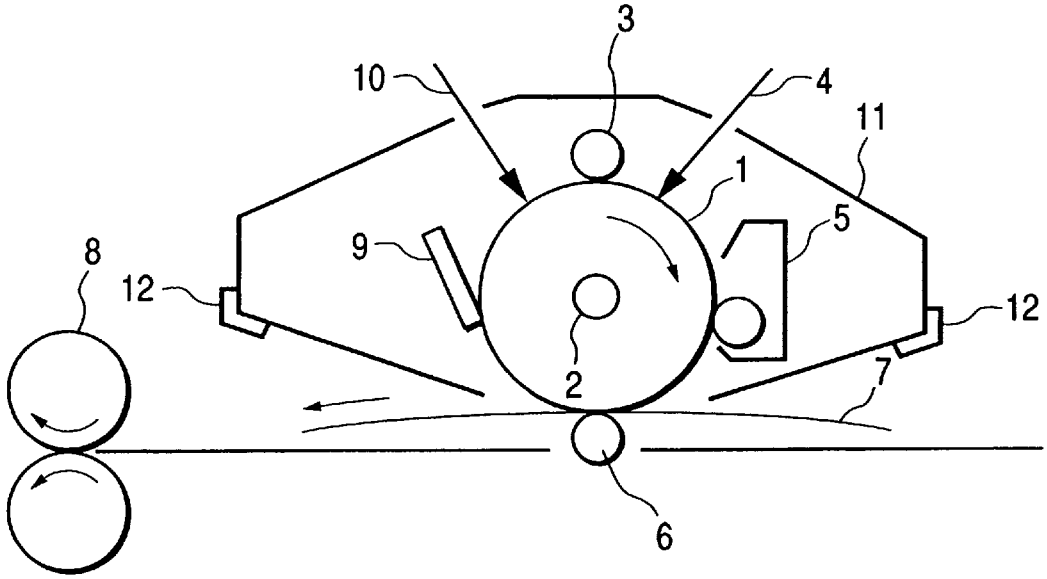
FIG. 5 schematically illustrates the construction of an electrophotographic apparatus having a process cartridge having the electrophotographic photosensitive member of the present invention.

FIG. 5 schematically illustrates the construction of an electrophotographic apparatus having a process cartridge with the electrophotographic photosensitive member of the present invention.

In FIG. 5, reference numeral 1 denotes an electrophotographic photosensitive member of the present invention, which is rotatively driven around an axis 2 in the direction of an arrow at a given peripheral speed. In the course of its rotation, the photosensitive member 1 is uniformly charged on its periphery to a positive or negative, given potential through a primary charging means 3. The photosensitive member thus charged is then exposed to light 4 emitted from an exposure means (not shown) for slit exposure or laser beam scanning exposure. In this way, electrostatic latent images are successively formed on the periphery of the photosensitive member 1.

The electrostatic latent images thus formed are subsequently developed with toner by the operation of a developing means 5. The resulting toner-developed images are then successively transferred by the operation of a transfer means 6, to the surface of a transfer medium 7 fed from a paper feed section (not shown) to the part between the photosensitive member 1 and the transfer means 6 while synchronized with the rotation of the photosensitive member 1.

The transfer medium 7 to which the images have been transferred is separated from the surface of the photosensitive member, is led to an image fixing means 8, where the images are fixed, and is then printed out of the apparatus as a copied material (a copy).

The surface of the photosensitive member 1 after the transfer of images, is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. In the apparatus shown in FIG. 5, when the primary charging means 3 is a contact charging means making use of a charging roller, the pre-exposure is not necessarily required.

In the present invention, the apparatus may be constituted of plural components integrally supported as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may integrally be supported in a cartridge together with the electrophotographic photosensitive member 1 to form a process cartridge 11 that is detachably mountable to the body of the apparatus through a guide means such as a rail 12 provided in the body of the apparatus.

Production examples for the GaPC used in the present invention are given below.

PRODUCTION EXAMPLE 1

73 g of o-phthalodinytrile, 25 g of gallium trichloride and 400 ml of α-chloronaphthalene were allowed to react at 200° C. for 4 hours in an atmosphere of nitrogen, and thereafter the product was filtered at 130° C. The resultant product was dispersed and washed at 130° C. for 1 hour using N,N'-dimethylformamide, followed by filtration and then washing with methanol, further followed by drying to obtain 45 g of chlorogallium phthalocyanine. Elemental analysis of this compound revealed the following.

Values of elemental analysis ($C_{32}H_{16}N_8ClGa$)

| | C | H | N | Cl |
|---|---|---|---|---|
| Found (%): | 61.78 | 2.66 | 18.28 | 6.25 |
| Calculated (%): | 62.22 | 2.61 | 18.14 | 5.74 |

15 g of the chlorogallium phthalocyanine obtained here was dissolved in 450 g of 10° C. concentrated sulfuric acid, and the solution obtained was added dropwise in 2,300 g of ice water with stirring to effect re-precipitation, followed by filtration. The filtrate obtained was dispersed and washed with 2% ammonia water, and then thoroughly washed with ion-exchanged water, followed by filtration and drying to obtain 13 g of low-crystalline HOGaPC.

PRODUCTION EXAMPLE 2

The HOGaPC obtained in Production Example 1 and 300 g of N,N'-dimethylformamide were treated by milling at room temperature (22° C.) for 6 hours using 450 g of glass beads of 1 mm diameter. From the resultant dispersion, solid matter was taken out and thoroughly washed with methanol and then with water, followed by drying to obtain 9.2 g of HOGaPC. This HOGaPC had strong peaks at 7.4° and 28.2° of the diffraction angle (2θ±0.2°) in CuKα characteristic X-ray diffraction. Elemental analysis of this compound revealed the following.

Values of elemental analysis ($C_{32}H_{17}N_8OGa$)

| | C | H | N | Cl |
|---|---|---|---|---|
| Found (%): | 62.77 | 2.61 | 18.33 | 0.53 |
| Calculated (%): | 64.14 | 2.86 | 18.70 | — |

PRODUCTION EXAMPLE 3

Figure 2:
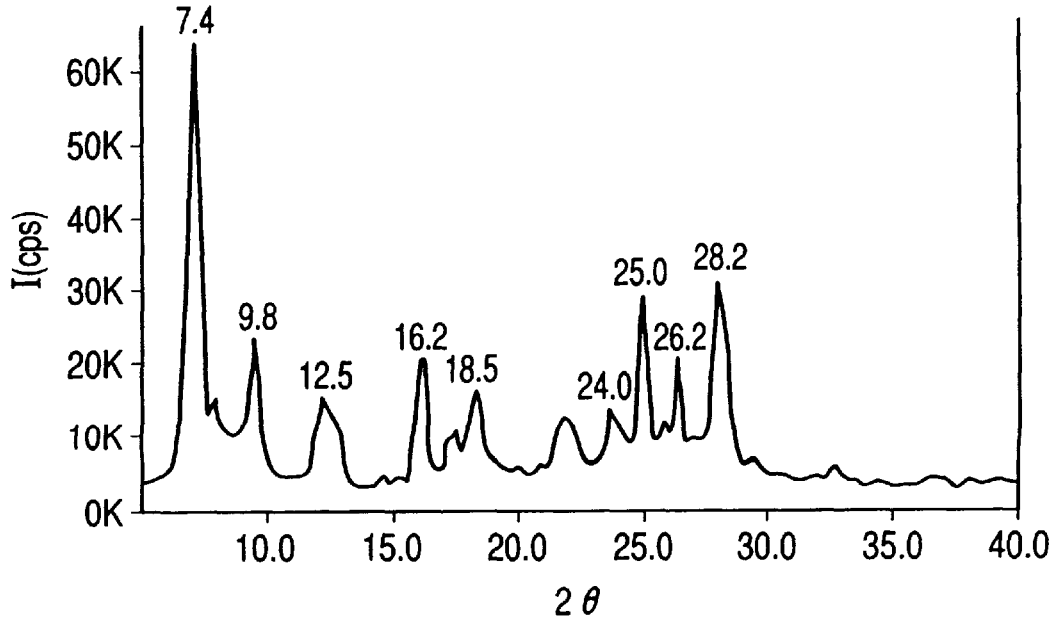
FIG. 2 shows an X-ray diffraction pattern of CuKα characteristics of hydroxygallium phthalocyanine synthesized in Production Example 3.

10 g of the HOGaPC obtained in Production Example 1 and 300 g of tetrahydrofuran were treated by milling at room temperature (22° C.) for 20 hours using 450 g of glass beads of 1 mm diameter. From the resultant dispersion, solid matter was taken out, and subsequently thoroughly washed with methanol and then with water, followed by drying to obtain 9.2 g of HOGaPC. This HOGaPC had strong peaks at 7.4° and 28.2° of the diffraction angle (2θ±0.2°) in CuKα characteristic X-ray diffraction (FIG. 2). Elemental analysis of this compound revealed the following.

Values of elemental analysis ($C_{32}H_{17}N_8OGa$)

| | C | H | N | Cl |
|---|---|---|---|---|
| Found (%): | 62.74 | 2.53 | 18.32 | 0.54 |
| Calculated (%): | 64.14 | 2.86 | 18.70 | — |

PRODUCTION EXAMPLE 4

Figure 3:
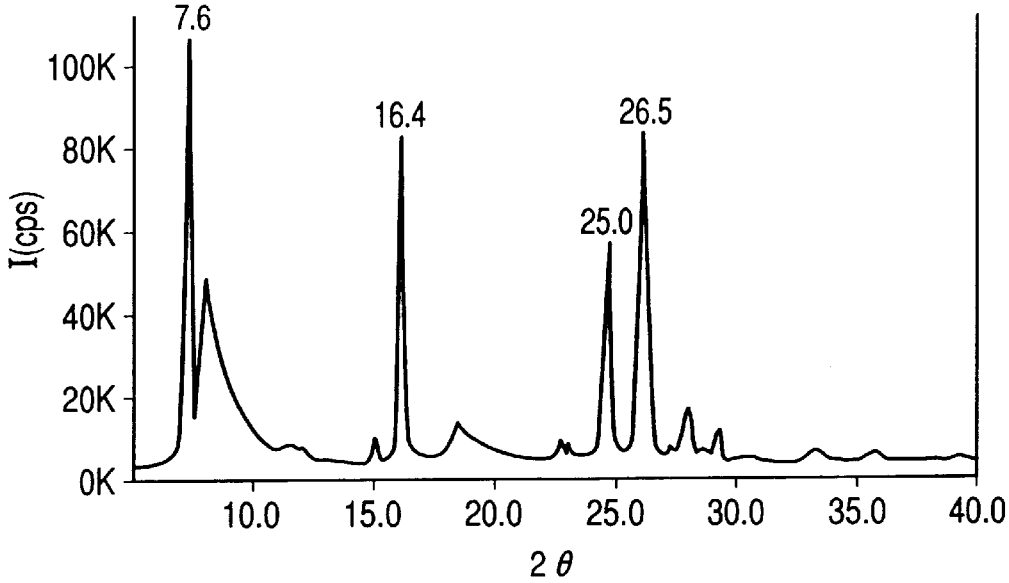
FIG. 3 shows an X-ray diffraction pattern of CuKα characteristics of hydroxygallium phthalocyanine synthesized in Production Example 4.

10 g of the HOGaPC obtained in Production Example 1 and 300 g of N,N'-dimethylaniline were treated by milling at room temperature (22° C.) for 6 hours using 450 g of glass beads of 1 mm diameter. From the resultant dispersion, solid matter was taken out and subsequently thoroughly washed with methanol and then with water, followed by drying to obtain 9.2 g of HOGaPC. This HOGaPC had strong peaks at 7.6°, 16.4°, 25.0° and 26.5° of the diffraction angle (2θ±0.2°) in CuKα characteristic X-ray diffraction (FIG. 3).

PRODUCTION EXAMPLE 5

10 g of the HOGaPC obtained in Production Example 1 and 300 g of chloroform were treated by milling at room temperature (22° C.) for 24 hours using 450 g of glass beads of 1 mm diameter. From the resultant dispersion, solid matter was taken out and subsequently thoroughly washed with methanol and then with water, followed by drying to obtain 9.2 g of HOGaPC. This HOGaPC had strong peaks at 7.6°, 16.4°, 25.0° and 26.5° of the diffraction angle (2θ±0.2°) in CuKα characteristic X-ray diffraction (FIG. 3).

PRODUCTION EXAMPLE 5

Figure 4:
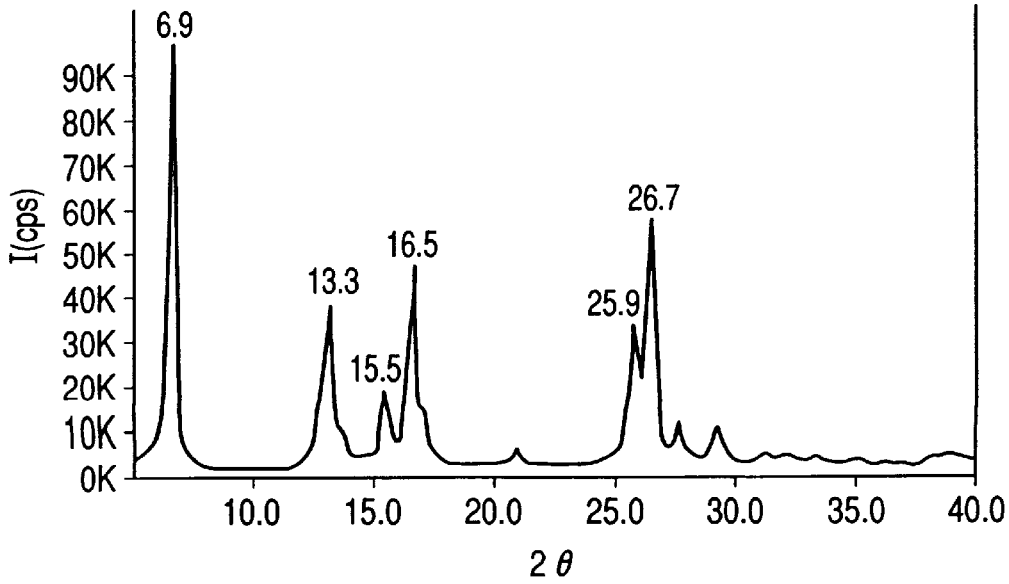
FIG. 4 shows an X-ray diffraction pattern of CuKα characteristics of hydroxygallium phthalocyanine synthesized in Production Example 5.

10 g of the HOGaPC obtained in Production Example 1 and 300 g of chloroform were treated by milling at room temperature (22° C.) for 24 hours using 450 g of glass beads of 1 mm diameter. From the resultant dispersion, solid matter was taken out and subsequently thoroughly washed with methanol and then water, followed by drying to obtain 9.2 g of HOGaPC. This HOGaPC had strong peaks at 6.9°, 16.5° and 26.7° of the diffraction angle (2θ±0.2°) in CuKα characteristic X-ray diffraction (FIG. 4).

COMPARATIVE PRODUCTION EXAMPLE 1

Production Example disclosed in Japanese Patent Application Laid-open No. 61-239248 (U.S. Pat. No. 4,728,592) was carried out to obtain oxytitanium phthalocyanine (TiOPC) having a crystal form called an α-type.

The present invention will be described below by giving Examples.

EXAMPLE 1-1

50 parts (parts by weight; the same applies hereinafter) of titanium oxide powder coated with tin oxide, containing 10% of antimony oxide, 25 parts of resol type phenol resin, 20 parts of methyl cellosolve, 5 parts of methanol and 0.002 parts of silicone oil (polydimehtylsiloxane-polyoxyalkylene copolymer; average molecular weight: 30,000) were dispersed for 2 hours by means of a sand mill making use of glass beads of 1 mm diameter to prepare a conductive coating fluid.

The coating fluid was applied on an aluminum cylinder by dip coating, followed by drying at 140° C. for 30 minutes to form a conductive layer with a layer thickness of 20 μm.

On this conductive layer, a solution prepared by dissolving 5 parts of a 6-66-610-12 polyamide tetrapolymer in a mixed solvent of 70 parts of methanol and 25 parts of butanol was dip-coated applied by dip coating, followed by drying to form a subbing layer with a layer thickness of 1 μm.

Next, to a solution prepared by dissolving 4 parts of polyvinyl butyral (trade name: S-LEC BX-1; available from Sekisui Chemical Co., Ltd.) in 100 parts of tetrahydrofuran, 7 parts of the HOGaPC obtained in Production Example 2 and 1 part of the disazo pigment of Exemplary Pigment (1)-8 were added. The mixture obtained was dispersed for 6 hours by means of a sand mill making use of glass beads of 1 mm diameter. To the dispersion thus obtained, 100 parts of butyl acetate was added to dilute it. Thereafter, the dilute dispersion was collected and was applied on the above subbing layer by dip doating, followed by drying at 100° C. for 10 minutes to form a charge generation layer with a layer thickness of 0.25 μm.

Next, 10 parts of a charge-transporting material represented by the following structural formula:

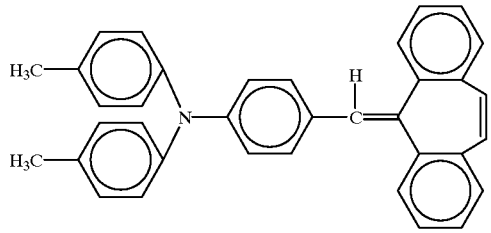

and 10 parts of bisphenol-Z type polycarbonate were dissolved in 60 parts of chlorobenzene to prepare a solution, and the solution was applied on the charge generation layer by dip coating, followed by drying at 110° C. for 1 hour to form a charge transport layer with a layer thickness of 23 μm.

The electrophotographic photosensitive member thus produced was installed in a copying machine (a modified machine of NP-4835, trade name, manufacture by CANON INC.) making use of a halogen lamp as exposure light source and also having an erasure exposure means comprising a semiconductor laser (wavelength: 785 nm), and evaluation was made on its electrophotographic performance. Measured were the amount of halogen light necessary for the light-area potential to attenuate to −130 V when the dark-area potential was set at −650 V, the amount of laser light necessary for the photosensitive member to have a surface potential of −80 V after erase exposure, and also the amount of change in surface potential (dark-area potential, light-area potential and post-erasure potential) when copied continuously on 1,000 sheets. Results obtained are shown in Table 1.

In the table, the plus signs in the data of the amount of change in potential indicate an increase in absolute value of potential, and the minus signs a decrease in absolute value of potential.

COMPARATIVE EXAMPLE 1-1

An electrophotographic photosensitive member was produced in the same manner as in Example 1-1 except that the disazo pigment of Exemplary Pigment (1)-8 was replaced with a disazo pigment represented by the following structural formula. Evaluation was made similarly. Results obtained are shown in Table 1.

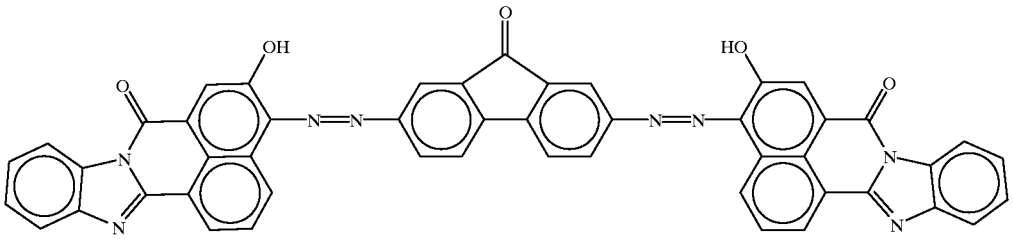

COMPARATIVE EXAMPLE 1-2

An electrophotographic photosensitive member was produced in the same manner as in Example 1-1 except that the HOGaPC was replaced with the TiOPC obtained in Comparative Production Example 1. Evaluation was made similarly. Results obtained are shown in Table 1.

TABLE 1

| | Amount of halogen light (lux•sec) | Amount of laser light ($\mu J/cm^2$) | Amount of charge after 1000-sheet copying* |
|---|---|---|---|
| Example 1-1 | 1.3 | 0.22 | −10/+10/+5 |
| Comparative Example 1-1 | 1.7 | 0.29 | −40/+30/+20 |
| Comparative Example 1-2 | 1.8 | 1.5 | −100/−40/−20 |

*dark-area potential/light-area potential/post-erasure potential

Thus, the photosensitive member of the present invention has a high sensitivity to both the visible light source and the infrared laser light source and, at the same time, has a sufficient stability of potential in continuous copying, showing superior performance. On the other hand, the photosensitive members of Comparative Examples do not satisfy the sensitivity to the both light sources and also show a great change in continuous potential caused by deterioration of memory characteristics.

EXAMPLE 1-2

An electrophotographic photosensitive member was produced in the same manner as in Example 1-1 except that the disazo pigment and the HOGaPC were added in a ratio of 1:1. Evaluation was made similarly. Results obtained are shown in Table 2.

EXAMPLE 1-3

An electrophotographic photosensitive member was produced in the same manner as in Example 1-1 except that Exemplary Pigment (1)-2 was used as the disazo pigment, the HOGaPC obtained in Production Example 2 was used as the HOGaPC, the ratio of disazo pigment/HOGaPC was changed to 5:1 and a hydrazone compound represented by the following structural formula was used as the charge-transporting material. Evaluation was made similarly. Results obtained are shown in Table 2.

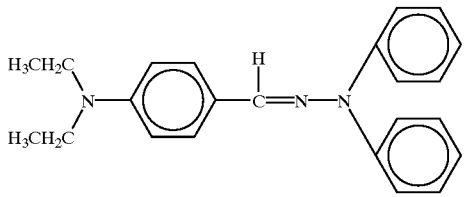

EXAMPLE 1-4

An electrophotographic photosensitive member was produced in the same manner as in Example 1-1 except that the HOGaPC obtained in Production Example 3 was used as the HOGaPC. Evaluation was made similarly. Results obtained are shown in Table 2.

EXAMPLE 1-5

An electrophotographic photosensitive member was produced in the same manner as in Example 1-1 except that the HOGaPC obtained in Production Example 4 was used as the HOGaPC. Evaluation was made similarly. Results obtained are shown in Table 2.

EXAMPLE 1-6

An electrophotographic photosensitive member was produced in the same manner as in Example 1-1 except that the HOGaPC obtained in Production Example 5 was used as the HOGaPC. Evaluation was made similarly. Results obtained are shown in Table 2.

EXAMPLE 1-7

An electrophotographic photosensitive member was produced in the same manner as in Example 1-1 except that a fluorenone compound represented by the following structural formula was used as the charge-transporting material. Evaluation was made similarly. Results obtained are shown in Table 2.

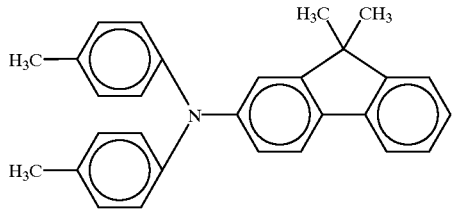

EXAMPLE 1-8

An electrophotographic photosensitive member was produced in the same manner as in Example 1-1 except that a benzidine compound represented by the following structural formula was used as the charge-transporting material. Evaluation was made similarly. Results obtained are shown in Table 2.

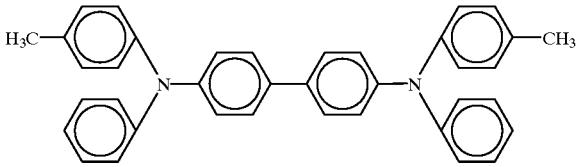

EXAMPLE 1-9

An electrophotographic photosensitive member was produced in the same manner as in Example 1-1 except that a hydrazone compound represented by the following structural formula was used as the charge-transporting material. Evaluation was made similarly. Results obtained are shown in Table 2.

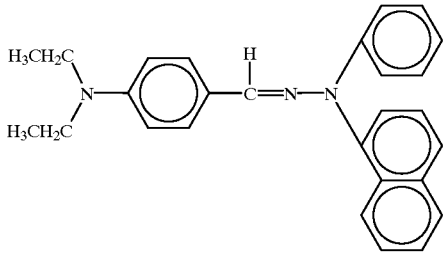

EXAMPLE 1-10

The procedure of Example 1 was repeated until the subbing layer was formed.

Subsequently, 8 parts of the disazo pigment of Exemplary Pigment (1)-27 was added to 4 parts of polyvinyl-4-fluorobenzal dissolved in 100 parts of tetrahydrofuran. The mixture obtained was dispersed for 30 minutes by means of a sand mill making use of glass beads of 1 mm diameter. To the dispersion thus obtained, 100 parts of 2-butanone was added to dilute it. Thereafter, the dilute dispersion was collected and was applied on the subbing layer by dip coating, followed by drying to form a charge generation layer. Its layer thickness was so adjusted that the disazo pigment in the layer was in a content of 100 mg/m$^2$.

Next, 5 parts of the HOGaPC obtained in Production Example 2 was added to 3 parts of the polyvinyl butyral (the same as used in Example 1-1) dissolved in 200 parts of 4-methoxy-4-methyl-2-pentanol. The mixture obtained was dispersed for 3 hours by means of a sand mill making use of glass beads of 1 mm diameter. To the dispersion thus obtained, 200 parts of ethyl acetate was added to dilute it. Thereafter, the dilute dispersion was collected and was applied onto the above charge generation layer containing the disazo pigment, followed by drying to form a charge generation layer containing the HOGaPC. Its layer thickness was so adjusted that the HOGaPC in the layer was in a content of 150 mg/m$^2$.

A charge transport layer was further formed thereon in the same manner as in Example 1-1, thus an electrophotographic photosensitive member was produced, and was evaluated in the same manner as in Example 1-1. Results obtained are shown in Table 2.

TABLE 2

| | Amount of halogen light (lux•sec) | Amount of laser light ($\mu$J/cm$^2$) | Amount of change after 1000-sheet copying* |
|---|---|---|---|
| Example 1–2 | 1.0 | 0.28 | −10/+10/+5 |
| Example 1–3 | 1.3 | 0.45 | −10/+20/+10 |
| Example 1–4 | 1.5 | 0.37 | −10/+10/+5 |
| Example 1–5 | 1.6 | 0.92 | −10/+15/+5 |
| Example 1–6 | 1.6 | 0.85 | −30/+15/+10 |
| Example 1–7 | 1.3 | 0.21 | −5/+10/+5 |
| Example 1–8 | 1.2 | 0.22 | −10/−10/+5 |
| Example 1–9 | 1.1 | 0.28 | −5/+5/0 |
| Example 1–10 | 1.0 | 0.20 | 0/+10/0 |

*dark-area potential/light-area potential/post-erasure potential

In the evaluation of images by visual observation, good images free of any faulty images such as dots and fog were formed using the photosensitive members of the present invention, but faulty images were seen in the images formed using the photosensitive member of Comparative Example.

EXAMPLE 2-1

50 parts (parts by weight; the same applies hereinafter) of titanium oxide powder coated with tin oxide, containing 10% of antimony oxide, 25 parts of resol type phenol resin, 20 parts of methyl cellosolve, 5 parts of methanol and 0.002 part of silicone oil (polydimehtylsiloxane-polyoxyalkylene copolymer; average molecular weight: 30,000) were dispersed for 2 hours by means of a sand mill making use of glass beads of 1 mm diameter to prepare a conductive coating fluid.

The coating fluid was applied onto an aluminum cylinder by dip coating, followed by drying at 140° C. for 30 minutes to form a conductive layer with a layer thickness of 20 $\mu$m.

On this conductive layer, a solution prepared by dissolving 5 parts of a 6-66-610-12 polyamide tetrapolymer in a mixed solvent of 70 parts of methanol and 25 parts of butanol was applied by dip coating, followed by drying to form a subbing layer with a layer thickness of 1 $\mu$m.

Next, 0.9 part of the disazo pigment of Exemplary Pigment (2)-15 and 50 parts of tetrahydrofuran were dispersed for 6 hours by means of a sand mill making use of glass beads of 1 mm diameter. To the dispersion obtained, a solution prepared by dissolving 9.1 parts of the HOGaPC obtained in Production Example 2 and 7 parts of polyvinyl butyral (trade name: S-LEC BX-1; available from Sekisui Chemical Co., Ltd.) in 70 parts of tetrahydrofuran was added, followed by further dispersion for 1 hour. To the dispersion thus obtained, 100 parts of butyl acetate was added to dilute it. Thereafter, the dilute dispersion was collected and was applied onto the above subbing layer by dip coating, followed by drying at 100° C. for 10 minutes to form a charge generation layer with a layer thickness of 0.25 $\mu$m.

Next, 10 parts of a charge-transporting material represented by the following structural formula:

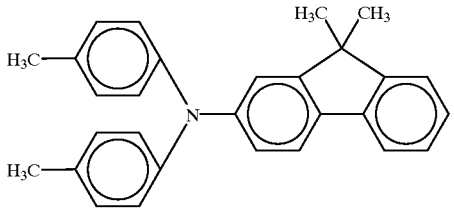

and 10 parts of bisphenol-Z type polycarbonate were dissolved in 60 parts of chlorobenzene to prepare a solution, and the solution was applied on the charge generation layer by dip coating, followed by drying at 130° C. for 1 hour to form a charge transport layer with a layer thickness of 22 $\mu$m.

The electrophotographic photosensitive member thus produced was installed in a modified machine of a digital copying machine (trade name: GP-55; manufacture by CANON INC.). Its surface was so set as to have a dark-area potential of −700 V, and was exposed to laser light of 780 nm, where the amount of light necessary for the potential of −700 V to attenuate to −150 V was measured to examine the sensitivity. The potential when exposed to light with energy of 20 $\mu$J/cm$^2$ was also measured as residual potential Vr. Results obtained were as shown below.

Sensitivity: 0.23 ($\mu$J/cm$^2$)

Residual potential Vr: −15 V

Next, in three environments of 15° C./10% RH, 18° C./50% RH and 35° C./80% RH, the initial dark-area potential was set at −700 V, and the initial light-area potential at −150 V, where a running test was made on 3,000 sheets continuously. After running, the dark-area potential and light-area potential were measured, and image quality was evaluated by visual observation. As a result, in all the environments, potential characteristics and image quality as good as those at the initial stage were maintained after the running.

EXAMPLE 2-2

An electrophotographic photosensitive member was produced in the same manner as in Example 2-1 except that the disazo pigment and the HOGaPC were used in amounts of 1.7 parts and 8.3 parts, respectively.

EXAMPLE 2-3

An electrophotographic photosensitive member was produced in the same manner as in Example 2-1 except that the disazo pigment and the HOGaPC were used in amounts of 5 parts and 5 parts, respectively.

EXAMPLE 2-4

An electrophotographic photosensitive member was produced in the same manner as in Example 2-1 except that the disazo pigment and the HOGaPC were used in amounts of 8.3 parts and 1.7 parts, respectively.

EXAMPLE 2-5

An electrophotographic photosensitive member was produced in the same manner as in Example 2-3 except that the HOGaPC obtained in Production Example 2 was replaced with the HOGaPC obtained in Production Example 3.

EXAMPLE 2-6

An electrophotographic photosensitive member was produced in the same manner as in Example 2-3 except that the HOGaPC obtained in Production Example 2 was replaced with the HOGaPC obtained in Production Example 4.

EXAMPLE 2-7

An electrophotographic photosensitive member was produced in the same manner as in Example 2-3 except that the HOGaPC obtained in Production Example 2 was replaced with the HOGaPC obtained in Production Example 5.

EXAMPLE 2-8

An electrophotographic photosensitive member was produced in the same manner as in Example 2-3 except that the disazo pigment of Exemplary Pigment (2)-15 was replaced with the disazo pigment Exemplary Pigment (2)-23 and a styryl compound represented by the following structural formula was used as the charge-transporting material.

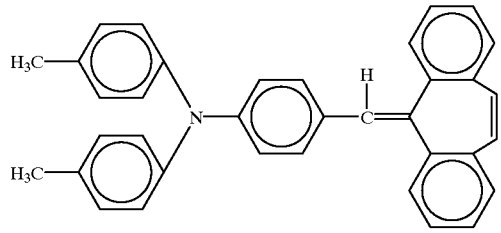

EXAMPLE 2-9

An electrophotographic photosensitive member was produced in the same manner as in Example 2-1 except that the disazo pigment of Exemplary Pigment (2)-15 was replaced with the disazo pigment Exemplary Pigment (2)-2 and a benzidine compound represented by the following structural formula was used as the charge-transporting material.

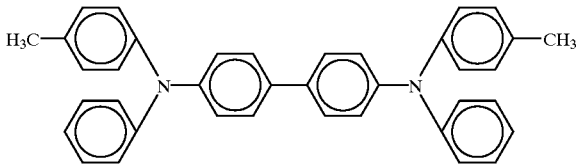

EXAMPLE 2-10

An electrophotographic photosensitive member was produced in the same manner as in Example 2-1 except that a hydrazone compound represented by the following structural formula was used as the charge-transporting material.

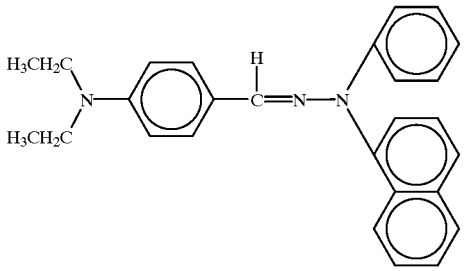

EXAMPLE 2-11

The procedure of Example 2–1 was repeated until the subbing layer was formed.

Subsequently, 8 parts of the disazo pigment of Exemplary Pigment (2)-28 was added to 4 parts of polyvinyl-4-fluorobenzal dissolved in 100 parts of tetrahydrofuran. The mixture obtained was dispersed for 30 hours by means of a sand mill making use of glass beads of 1 mm diameter. To the dispersion thus obtained, 100 parts of 2-butanone was added to dilute it. Thereafter, the dilute dispersion was collected and was applied onto the subbing layer by dip coating, followed by drying to form a charge generation layer. Its layer thickness was so adjusted that the disazo pigment in the layer was in a content of 100 mg/$M^2$.

Next, 5 parts of the HOGaPC obtained in Production Example 2 was added to 3 parts of the polyvinyl butyral (the same as used in Example 2-1) dissolved in 200 parts of 4-methoxy-4-methyl-2-pentanol. The mixture obtained was dispersed for 3 hours by means of a sand mill making use of glass beads of 1 mm diameter. To the dispersion thus obtained, 200 parts .of ethyl acetate was added to dilute it. Thereafter, the dilute dispersion was collected and was applied onto the above charge generation layer containing the disazo pigment by dip coating, followed by drying to form a charge generation layer containing the HOGaPC. Its layer thickness was so adjusted that the HOGaPC in the layer was in a content of 150 mg/$M^2$.

A charge transport layer was further formed thereon in the same manner as in Example 2-1, thus an electrophotographic photosensitive member was produced.

COMPARATIVE EXAMPLE 2-1

An electrophotographic photosensitive member was produced in the same manner as in Example 2-3 except that the HOGaPC obtained in Production Example 2 was replaced with the TiOPC obtained in Comparative Production Example 1.

COMPARATIVE EXAMPLE 2-2

An electrophotographic photosensitive member was produced in the same manner as in Example 2-3 except that the disazo pigment was replaced with a disazo pigment represented by the following structural formula.

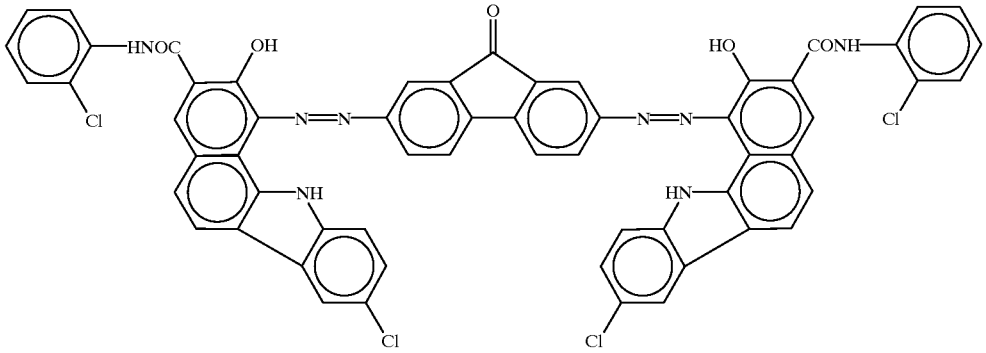

On these electrophotographic photosensitive members, their sensitivity and residual potential Vr were measured in the same manner as in Example 2-1. Results obtained are shown in Table 3.

TABLE 3

| | Sensitivity ($\mu$J/cm$^2$) | Vr (−V) |
|---|---|---|
| Example 2–2 | 0.23 | 12 |
| Example 2–3 | 0.27 | 10 |
| Example 2–4 | 0.32 | 8 |
| Example 2–5 | 0.40 | 10 |
| Example 2–6 | 0.45 | 10 |
| Example 2–7 | 0.51 | 10 |
| Example 2–8 | 0.25 | 8 |
| Example 2–9 | 0.32 | 10 |
| Example 2–10 | 0.26 | 15 |
| Example 2–11 | 0.24 | 6 |
| Comparative Example 2–1 | 1.05 | 40 |
| Comparative Example 2–2 | 0.72 | 35 |

Setting the initial dark-area potential at −700 V and the initial light-area potential at −150 V, a running test was made on 3,000 sheets continuously. The dark-area potential and the light-area potential were measured at the initial stage and at the time the 3,000-sheet running was finished, determining the amount of change in the dark-area potential ΔVd and the amount of change in the light-area potential ΔV1. In the table, the plus signs in the data of the amount of changes indicate an increase in absolute value of potential, and the minus signs a decrease in absolute value of potential. Evaluation was also made on black dots and fog by visual observation after running.

Results obtained are shown in Table 4.

TABLE 4

| | Evaluation on black dots and fog | ΔVd (V) | ΔVl (V) |
|---|---|---|---|
| Example 2–2 | good | −5 | 0 |
| Example 2–3 | good | −5 | +5 |
| Example 2–4 | good | 0 | +10 |
| Example 2–5 | good | −5 | −5 |
| Example 2–6 | good | 0 | −5 |
| Example 2–7 | good | +10 | +10 |
| Example 2–8 | good | 0 | −5 |
| Example 2–9 | good | −10 | 0 |

TABLE 4-continued

| | Evaluation on black dots and fog | ΔVd (V) | ΔVl (V) |
|---|---|---|---|
| Example 2–10 | good | −5 | +10 |
| Example 2–11 | good | 0 | +5 |
| Comparative Example 2–1 | poor | −60 | −40 |
| Comparative Example 2–2 | poor | −50 | +70 |

As can be seen from the above results, the electrophotographic photosensitive members of the present invention show a small residual potential, are free from faulty images such as black spots and fog, and have high sensitivity characteristics and stable potential characteristics in their repeated use.

What is claimed is:

1. An electrophotographic photosensitive member comprising a support and a photosensitive layer provided on the support;

said photosensitive layer containing a disazo pigment represented by the following Formula (1) or (2) and a hydroxygallium phthalocyanine;

(1)

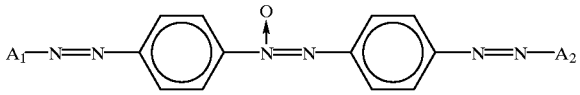

wherein $A_1$ and $A_2$ may be the same or different and each represent a coupler residual group having a phenolic hydroxyl group;

(2)

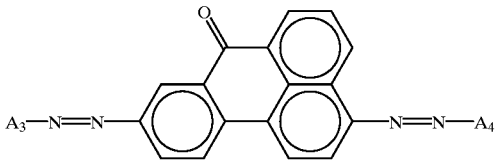

wherein $A_3$ and $A_4$ may be the same or different and each represent a coupler residual group having a phenolic hydroxyl group.

2. The electrophotographic photosensitive member according to claim 1, wherein said photosensitive layer contains the disazo pigment represented by the Formula (1) and the hydroxygallium phthalocyanine.

3. The electrophotographic photosensitive member according to claim 1, wherein said photosensitive layer contains the disazo pigment represented by the Formula (2) and the hydroxygallium phthalocyanine.

4. The electrophotographic photosensitive member according to claim 1, wherein $A_1$ to $A_4$ are each a group represented by the formula selected from the group consisting of the Formulas (3) to (6);

(3)

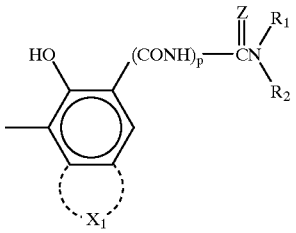

wherein $X_1$ represents a group which combines with the benzene ring in the formula to form an aromatic hydrocarbon ring which may be substituted or a heterocyclic ring which may be substituted; $R_1$ and $R_2$ may be the same or different and each represent a hydrogen atom, an alkyl group which may be substituted, an aryl group which may be substituted, an aralkyl group which may be substituted or a heterocyclic ring which may be substituted, and $R_1$ and $R_2$ may be combined to form a cyclic amino group together with the nitrogen atom in the formula; Z represents an oxygen atom or a sulfur atom; and p represents 0 or 1;

(4)

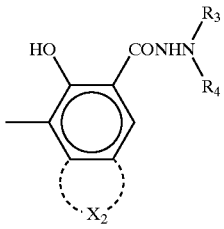

wherein $X_2$ represents a group which combines with the benzene ring in the formula to form an aromatic hydrocarbon ring which may be substituted or a heterocyclic ring which may be substituted; and $R_3$ and $R_4$ may be the same or different and each represent a hydrogen atom, an alkyl group which may be substituted, an aryl group which may be substituted, an aralkyl group which may be substituted or a heterocyclic ring which may be substituted, and $R_3$ and $R_4$ may be combined to form a cyclic amino group together with the nitrogen atom in the formula;

(5)

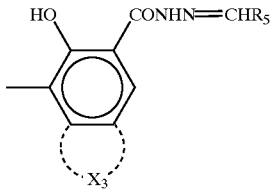

wherein $X_3$ represents a group which combines with the benzene ring in the formula to form an aromatic hydrocarbon ring which may be substituted or a heterocyclic ring which may be substituted; and $R_5$ represents a hydrogen atom, an alkyl group which may be substituted, an aryl group which may be substituted, an aralkyl group which may be substituted or a heterocyclic ring which may be substituted;

(6)

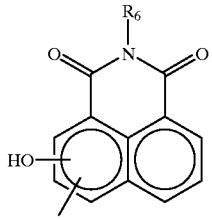

wherein $R_6$ represents an alkyl group which may be substituted, an aryl group which may be substituted, an aralkyl group which may be substituted or a heterocyclic ring which may be substituted.

5. The electrophotographic photosensitive member according to claim 4, wherein $A_1$ to $A_4$ are each the group represented by Formula (3).

6. The electrophotographic photosensitive member according to claim 1, wherein said disazo pigment represented by Formula (1) is a disazo pigment represented by the following formula:

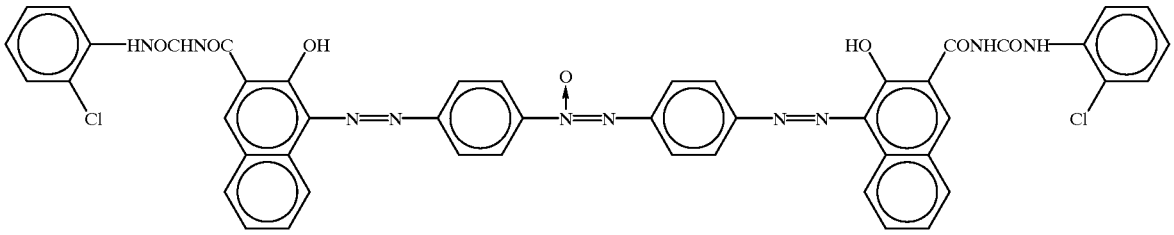

7. The electrophotographic photosensitive member according to claim 1, wherein said disazo pigment represented by Formula (2) is a disazo pigment represented by the following formula:

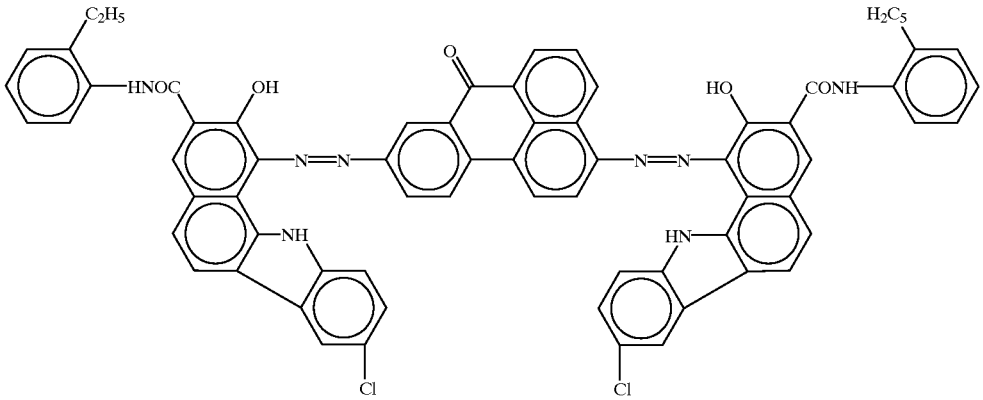

8. The electrophotographic photosensitive member according to claim 1, wherein said hydroxygallium phthalocyanine has strong peaks at 7.4°±0.2° and 28.2°±0.2° of the diffraction angle (2θ) in CuKα characteristic X-ray diffraction.

9. The electrophotographic photosensitive member according to claim 1, wherein said photosensitive layer comprises a charge generation layer and a charge transport layer, and the charge generation layer contains the disazo pigment represented by the Formula (1) or (2) and the hydroxygallium phthalocyanine.

10. A process cartridge comprising an electrophotographic photosensitive member and at least one of means selected from the group consisting of a charging means, a developing means and a cleaning means;

said electrophotographic photosensitive member and at least one of said means being supported as one unit and being detachably mountable to the main body of an electrophotographic apparatus; and said electrophotographic photosensitive member comprising a support and a photosensitive layer provided on the support;

said photosensitive layer containing a disazo pigment represented by the following Formula (1) or (2) and a hydroxygallium phthalocyanine:

(1)

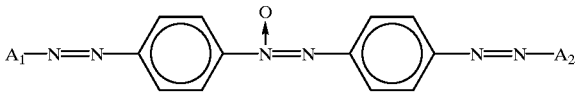

wherein $A_1$ and $A_2$ may be the same or different and each represent a coupler residual group having a phenolic hydroxyl group;

(2)

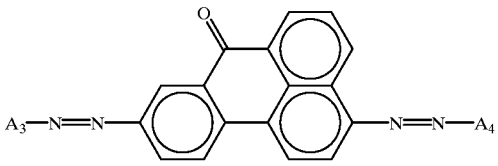

wherein $A_3$ and $A_4$ may be the same or different and each represent a coupler residual group having a phenolic hydroxyl group.

11. An electrophotographic apparatus comprising an electrophotographic photosensitive member, a charging means, an exposure means, a developing means and a transfer means;

said electrophotographic photosensitive member comprising a support and a photosensitive layer provided on the support;

said photosensitive layer containing a disazo pigment represented by the following Formula (1) or (2) and a hydroxygallium phthalocyanine:

(1)

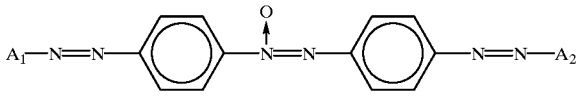

wherein $A_1$ and $A_2$ may be the same or different and each represent a coupler residual group having a phenolic hydroxyl group;

(2)

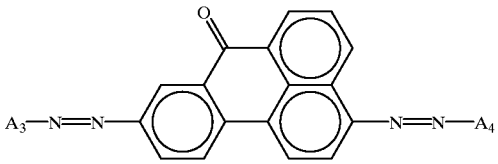

wherein $A_3$ and $A_4$ may be the same or different and each represent a coupler residual group having a phenolic hydroxyl group.

* * * * *